US010242812B2

(12) United States Patent
Fukuda et al.

(10) Patent No.: US 10,242,812 B2
(45) Date of Patent: Mar. 26, 2019

(54) ELECTRIC APPLIANCE

(71) Applicant: KYOCERA Document Solutions Inc., Osaka (JP)

(72) Inventors: Motoyuki Fukuda, Osaka (JP); Hiroyuki Tanaka, Osaka (JP); Tetsuya Ichiguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/290,626

(22) Filed: Oct. 11, 2016

(65) Prior Publication Data

US 2017/0148585 A1 May 25, 2017

(30) Foreign Application Priority Data

Nov. 25, 2015 (JP) ..... 2015-229427

(51) Int. Cl.
*H01H 9/16* (2006.01)
*B41J 29/00* (2006.01)

(52) U.S. Cl.
CPC ..... *H01H 9/16* (2013.01); *B41J 29/00* (2013.01); *H01H 2231/012* (2013.01)

(58) Field of Classification Search
CPC ..... H01H 9/16; H01H 2231/012
USPC ..... 200/294, 308, 339, 293, 296, 297, 315, 200/333
See application file for complete search history.

(56) References Cited

U.S. PATENT DOCUMENTS 8,829,374 B2 * 9/2014 Uchida ..... G03G 15/5016 200/294
2005/0155850 A1 * 7/2005 Holsten ..... H01H 23/14 200/339
2006/0180446 A1 * 8/2006 Yamada ..... B41J 29/13 200/293
2011/0280608 A1 11/2011 Amemiya et al. ..... 399/88

FOREIGN PATENT DOCUMENTS

JP 11-121940 A 4/1999
JP 2006-246387 A 9/2006
JP 2008-59769 A 3/2008
JP 2011-244112 A 12/2011

OTHER PUBLICATIONS

Japanese Office Action dated May 18, 2018, issued by the Japanese Patent Office in corresponding application JP 2015-229427.

* cited by examiner

*Primary Examiner* — Edwin A. Leon
*Assistant Examiner* — Lheiren Mae A Caroc
(74) *Attorney, Agent, or Firm* — Stein IP, LLC

(57) ABSTRACT

An electric appliance includes an appliance main body, a recess, and a power switch. The recess is arranged in a side surface of the appliance main body, and has a front surface-side inclined surface which is inclined to the side surface and which points to the rear surface side of the appliance main body. The power switch is arranged on the front surface-side inclined surface not to protrude out beyond the side surface.

7 Claims, 4 Drawing Sheets

ELECTRIC APPLIANCE

INCORPORATION BY REFERENCE

This application is based upon and claims the benefit of priority from the corresponding Japanese Patent Application No. 2015-229427 filed on Nov. 25, 2015, the entire contents of which are incorporated herein by reference.

BACKGROUND

The present disclosure relates to electric appliances such as image forming apparatuses, like copiers, printers, and facsimile machines, scanners, air purifiers, and personal computers. More particularly, the present disclosure relates to electric appliances provided with a power switch in a side surface.

For example, in a conventional electric appliance such as an image forming apparatus, a power switch is arranged in a front surface of the appliance main body from the perspective of operability and visibility.

A conventional image forming apparatus (electric appliance) is known in which a recess having an inclined surface which points to a front surface side is arranged in a side surface of the appliance main body, and a power switch is arranged on the inclined surface. In this image forming apparatus, the power switch is arranged inside the recess in the side surface of the appliance main body, and it is thus possible to reduce erroneous operation of the power switch by a user to some degree.

SUMMARY

According to one aspect of the present disclosure, an electric appliance includes an appliance main body, a recess, and a power switch. The recess is arranged in a side surface of the appliance main body, and has a front inclined surface which is inclined with respect to the side surface and which points to the rear surface side of the appliance main body. The power switch is arranged on the front inclined surface so as not to protrude out beyond the side surface.

Further features and advantages of the present disclosure will become apparent from the description of embodiments given below.

DETAILED DESCRIPTION

Hereinafter, embodiments of the present disclosure will be described with reference to the accompanying drawings.

First Embodiment

Figure 1:
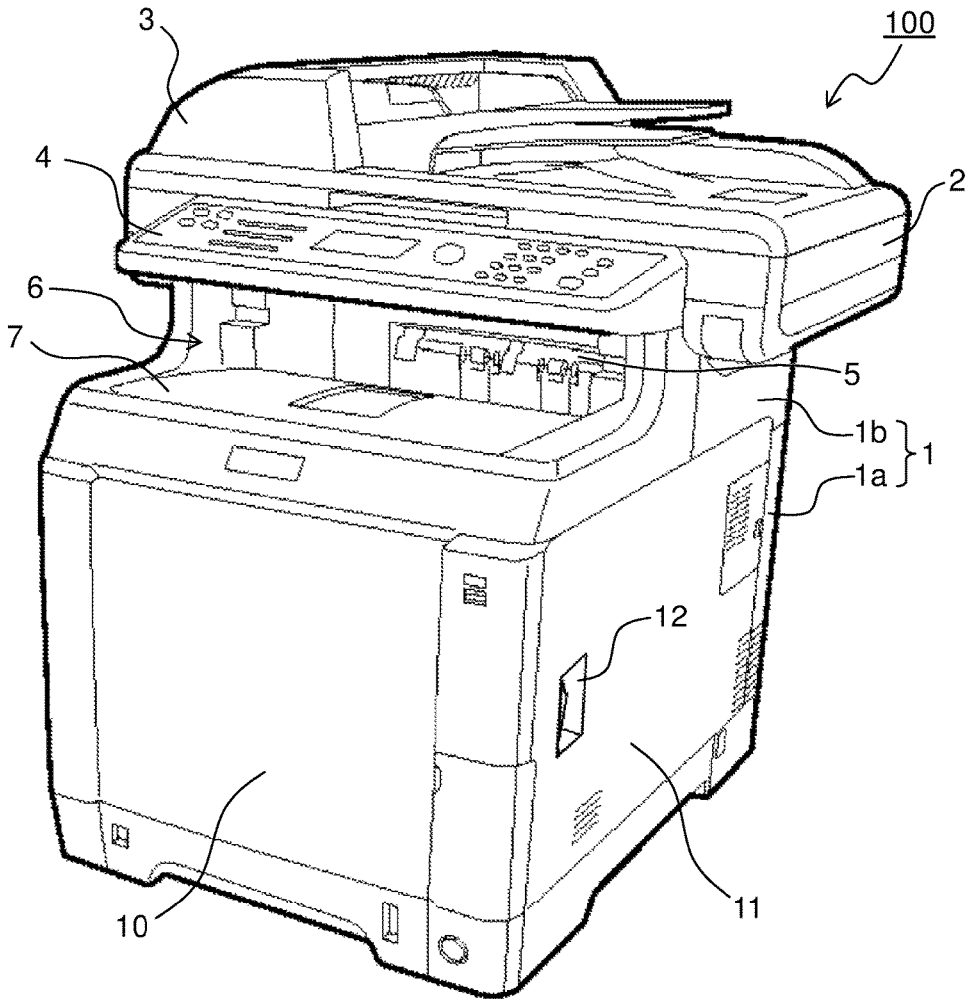
FIG. 1 is an exterior perspective view of an image forming apparatus according to a first embodiment of the present disclosure.

FIG. 1 is an exterior perspective view of an image forming apparatus 100 according to a first embodiment of the present disclosure. As shown in FIG. 1, the image forming apparatus (electric appliance) 100 is a digital multifunction peripheral of a so-called internal sheet discharge type, and is composed roughly of a body housing 1 and an upper housing 2 arranged thereon.

In the upper housing 2, an image reading portion is provided for reading an image of a document as an electrical signal. In the body housing 1, various mechanisms as will be described later are provided for transferring an image to a sheet based on the electrical signal of the document image which has been read. On the top surface of the upper housing 2, a document transport device 3 is arranged for separating and transporting one document sheet after another to the image reading portion. An operation panel 4 is arranged so as to protrude frontward of the image forming apparatus 100 from the front surface of the upper housing 2.

The body housing 1 is composed of a lower housing 1*a* and a coupling housing 1*b* which is arranged above the lower housing 1*a* along a rear part and which is coupled to the upper housing 2. In the lower housing 1*a*, there are arranged a sheet feed portion, an image forming portion for forming a toner image on a sheet, a fixing device for fixing a toner image on a sheet, etc. (none of these is illustrated). On the other hand, in the coupling housing 1*b*, there is arranged a sheet discharge portion 5 for transporting a sheet which has been subjected to fixing to discharge the sheet out of the body housing 1.

In front of the coupling housing 1*b* right under the upper housing 2, there is formed an internal sheet discharge space 6 widely open to the front. In the internal sheet discharge space 6, a sheet discharge tray 7 is arranged for receiving and stacking sheets discharged from the sheet discharge portion 5 of the coupling housing 1*b*.

The lower housing 1*a* has a front surface 10, a right side surface 11 and a left side surface which are arranged on the right and left, respectively, as seen from in front of the image forming apparatus 100, and a rear surface. Inside the image forming apparatus 100, an exhaust fan (unillustrated) is arranged for exhausting air warmed by the heat radiated from the fixing device, etc. to the outside, and the air is exhausted out through an exhaust duct (unillustrated) arranged on the left side surface of the lower housing 1*a*.

Figure 2:
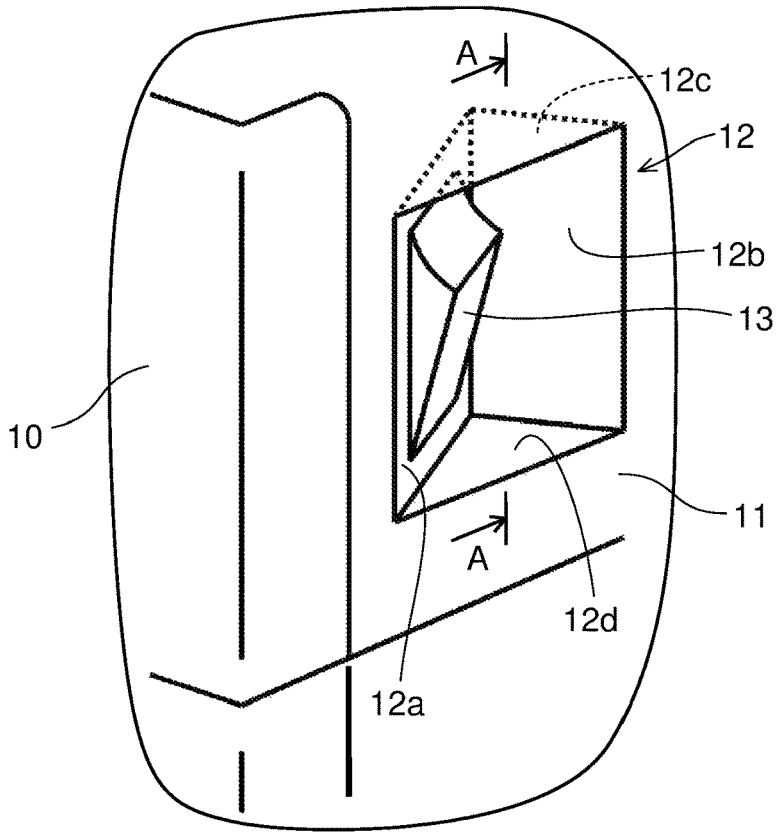
FIG. 2 is a perspective view showing a structure of and around a recess of the image forming apparatus according to the first embodiment of the present disclosure.

In a part of the right side surface 11 near the front surface 10, a recess 12 is arranged. As shown in FIG. 2, the recess 12 is composed of a front surface-side inclined surface 12*a* which is inclined with respect to the right side surface 11 and which points to the rear surface side (rear side) of the main body of the image forming apparatus 100, a rear surface-side inclined surface 12*b* which is inclined with respect to the right side surface 11 and which points to the front surface 10-side, a top surface 12*c*, and a bottom surface 12*d*.

On the front surface-side inclined surface 12*a*, a power switch 13 is arranged for turning on and off the image forming apparatus 100. The power switch 13 is arranged so as not to protrude out beyond the right side surface 11.

Figure 3:
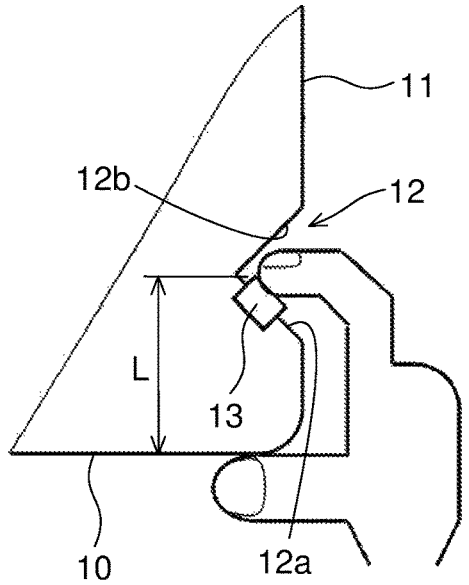
FIG. 3 is a sectional plan view showing a structure of and around the recess of the image forming apparatus according to the first embodiment of the present disclosure.

As shown in FIG. 3, the power switch 13 is arranged at such a position that a user can operate (turn on/off) it with the user's middle finger while keeping the thumb on the front surface 10. Specifically, the distance L from the front surface 10 to a rear end part (the part farthest from the front surface 10) of the power switch 13 is set at 10 cm or less.

Figure 4:
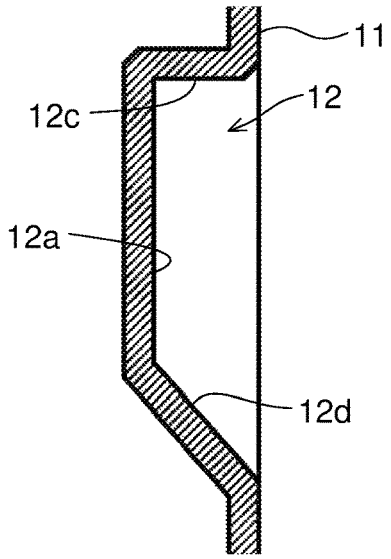
FIG. 4 is a sectional view across line A-A in FIG. 2.

As shown in FIG. 4, the top surface 12*c* is formed horizontal, while the bottom surface 12*d* is formed so as to descend outward.

In this embodiment, as described above, in the right side surface 11, the recess 12 is arranged that has the front surface-side inclined surface 12*a* which is inclined with respect to the right side surface 11 and which points to the rear surface side, and the power switch 13 is arranged on the front surface-side inclined surface 12*a* so as not to protrude out beyond the right side surface 11. This helps adequately prevent the power switch 13 from being seen by a user, and thus helps adequately reduce erroneous operation of the power switch 13 by a user. This does not pose a problem because an administrator and the like of the image forming apparatus 100 know where the power switch 13 is.

Figure 7:
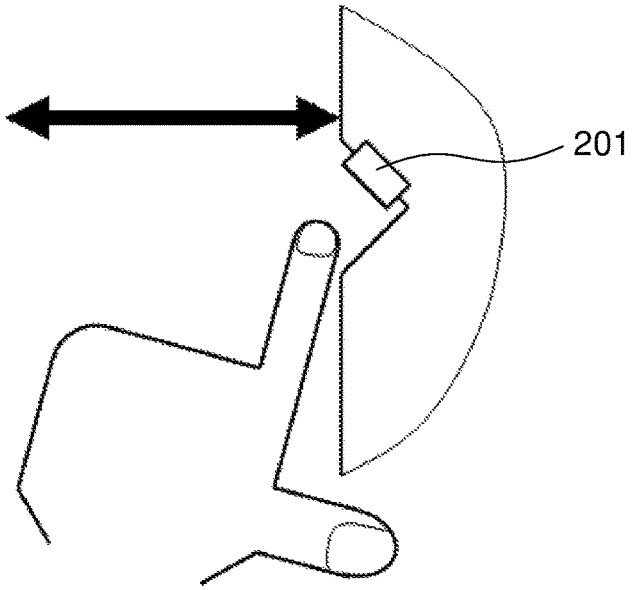
FIG. 7 is a diagram showing the direction of a user's hand when operating a power switch in a structure where a recess having an inclined surface which points to a front surface side is arranged in a side surface of an electric appliance and the power switch is arranged on the inclined surface.

As a result of the power switch 13 being arranged on the front surface-side inclined surface 12*a*, as compared with a case, for example, where a power switch 201 is arranged on an inclined surface pointing to the front surface side as shown in FIG. 7, it is possible to reduce the distance from the front surface 10 to the power switch 13. This permits a user's finger to reach the power switch 13 easily, and thus eliminates the need to put the hand deep into a gap between the right side surface 11 and a wall opposite it. Thus, even when the gap is narrow, it is possible to alleviate degradation of the operability of the power switch 13.

As a result of the power switch 13 being arranged on the front surface-side inclined surface 12*a*, when the power switch 13 is operated, the power switch 13 is operated with the back of the hand held upright as shown in FIG. 3 (with the palm pointing in the horizontal direction). Thus, even when the gap between the right side surface 11 and a wall opposite it is narrow (about five cm), it is possible to alleviate degradation of the operability of the power switch 13. For example, in a case where a power switch 201 is arranged on an inclined surface pointing to the front surface side as shown in FIG. 7, although it is easier to operate the power switch 201 with the back of the hand held horizontal (with the palm pointing in the down direction), it is difficult to put the hand into the gap between a side surface and a wall opposite it; this results in degraded operability of the power switch 201.

As described above, the power switch 13 is arranged at such a position that a user can operate it with the user's middle finger while keeping the thumb on the front surface 10. Thus, the power switch 13 can be operated with such a movement as to hold it between the thumb and the middle or another finger as shown in FIG. 3, and this makes it possible to further improve the operability of the power switch 13.

As described above, the recess 12 has the bottom surface 12*d* which descends outward. This helps prevent dust from collecting on the bottom surface 12*d* of the recess 12, and thus helps prevent the hand from being soiled with dust during operation of the power switch 13.

Second Embodiment

Figure 5:
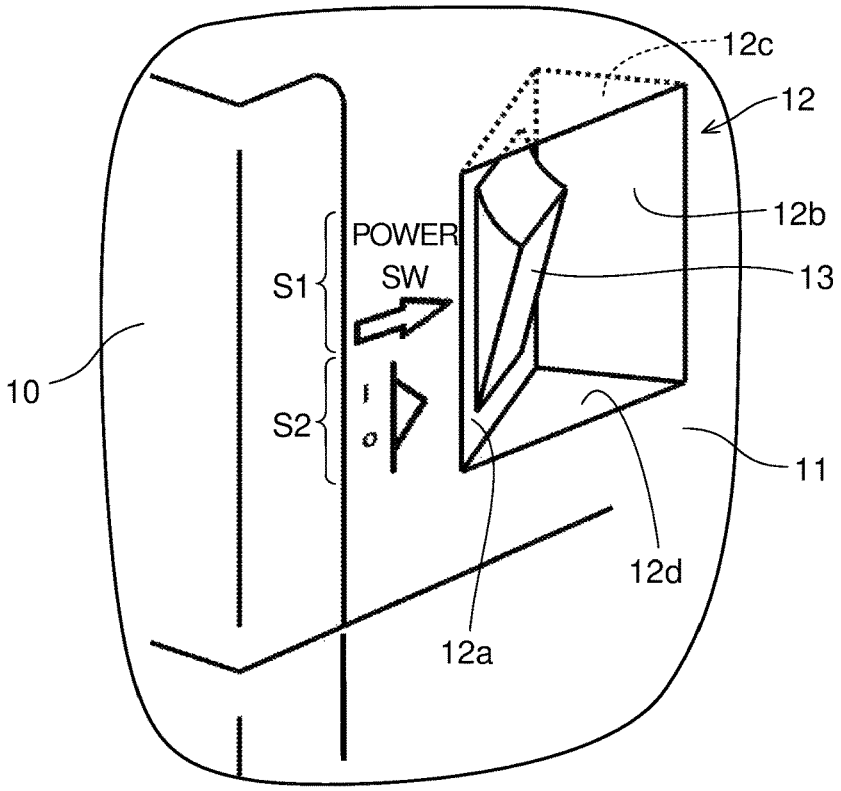
FIG. 5 is a perspective view showing a structure of and around a recess of an image forming apparatus according to a second embodiment of the present disclosure.

In a second embodiment of the present disclosure, as shown in FIG. 5, on the right side surface 11 near the recess 12, there are provided an indication S1 that indicates the presence of the power switch 13, and an indication S2 that indicates the On/Off positions of the power switch 13. The indications S1 and S2 are arranged on the right side surface 11 between the recess 12 and the front surface 10.

Otherwise, the structure in the second embodiment is similar to that in the previously-described first embodiment.

In this embodiment, as described above, near the recess 12, the indication S1 that indicates the presence of the power switch 13 is provided. Thus, it is possible to know where the power switch 13 is.

As described above, near the recess 12, the indication S2 that indicates the On/Off positions of the power switch 13 is provided. Thus, it is possible to turn on and off the power switch 13 easily.

Otherwise, the effects of the second embodiment are similar to those of the previously-described first embodiment.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, although an example has been dealt with in which the present disclosure is applied to a digital multifunction peripheral, this is not meant as any limitation. Needless to say, the present disclosure is applicable to image forming apparatuses such as monochrome printers, color printers, color multifunction peripherals, facsimile machines, etc. The present disclosure is applicable not only to image forming apparatuses but also to electric appliances such as scanners, air purifiers, personal computers, etc.

Figure 6:
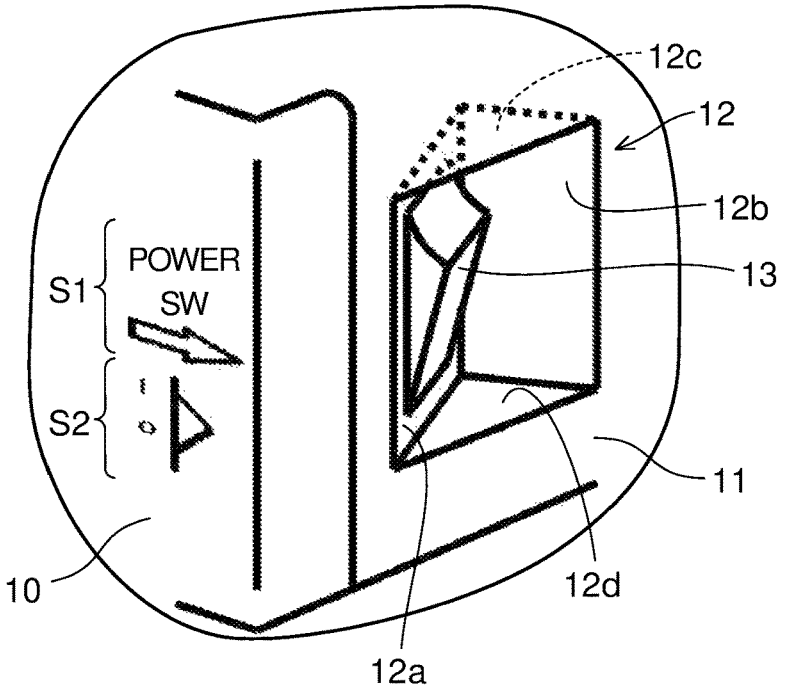
FIG. 6 is a perspective view showing a structure of and around a recess of an image forming apparatus according to a modified example of the present disclosure.

For another example, in the above-described second embodiment, although an example has been dealt with in which the indications S1 and S2 are provided on the right side surface 11 near the recess 12, this is in no way meant to limit the present disclosure. For example, as in the image forming apparatus 100 according to a modified example of the present disclosure shown in FIG. 6, indications S1 and S2 may be provided on the front surface 10 near the recess 12. With this configuration, it is possible to know where the power switch 13 is, and to turn it on and off easily, even from in front of the image forming apparatus 100.

The technical scope of the present disclosure encompasses any structure obtained by combining together different features from the above-described embodiments and modified examples as necessary.

What is claimed is:

1. An electric appliance comprising:

an appliance main body having an exterior surface including a front surface, side surfaces arranged respectively at left and right sides of the front surface so as to sandwich the front surface, and a rear surface arranged opposite the front surface;

an operation portion arranged at a front surface side of the appliance main body;

a recess arranged in a front surface-side part of one of the side surfaces of the exterior surface of the appliance main body, the recess having a front surface-side inclined surface which is inclined inward of the appliance main body with respect to a left-right direction thereof from front to rear, with respect to the one of the side surfaces; and a power switch arranged on the front surface-side inclined surface so as not to protrude out beyond the side surface.

2. The electric appliance of claim 1, wherein
the power switch is arranged at such a position that a user can operate the power switch with a middle finger while keeping a thumb on the front surface of the appliance main body with such a movement as to hold the power switch between the thumb and the middle finger.

3. The electric appliance of claim 1, wherein
an indication that indicates presence of the power switch is provided near the recess.

4. The electric appliance of claim 3, wherein
the indication that indicates the presence of the power switch is provided on the front surface of the appliance main body near the recess.

5. The electric appliance of claim 1, wherein
an indication that indicates On/Off positions of the power switch is provided near the recess.

6. The electric appliance of claim 5, wherein
the indication that indicates the On/Off positions of the power switch is provided on the front surface of the appliance main body near the recess.

7. The electric appliance of claim 1, wherein
the recess has a bottom surface which descends outward.

* * * * *